United States Patent [19]

Spector

[11] Patent Number: 4,834,382

[45] Date of Patent: May 30, 1989

[54] INFLATABLE PLAY BALL

[76] Inventor: Donald Spector, 380 Mountain Rd., Union City, N.J. 07087

[21] Appl. No.: 205,477

[22] Filed: Jun. 13, 1988

[51] Int. Cl.[4] ..... A63B 41/00

[52] U.S. Cl. ..... 273/65 EG; 273/DIG. 020; 273/DIG. 030; 273/DIG. 006; 273/58 BA; 273/65 A

[58] Field of Search ..... 446/225; 273/DIG. 020, 273/58 B, 58 BA, 65 R, 65 B, 65 E, 65 ED, 65 EB, 65 EC, 65 EE, 65 EF, 65 F, 65 A, 65 C, 65 D

[56] References Cited

U.S. PATENT DOCUMENTS 4,758,199 7/1988 Tillotson ..... 446/225

*Primary Examiner*—George J. Marlo

*Attorney, Agent, or Firm*—Michael Ebert

[57] ABSTRACT

A child's play ball constituted by an outer casing and an inner inflatable bladder. The outer casing is formed by contoured segments of high strength, non-stretchable fabric material stitched together to define, when the casing is fully expanded, a play ball of the desired shape and size, such as a football or soccer ball. The inner bladder is a conventional rubber balloon whose stem initially projects through an opening in the casing which is provided with a closure. The stem, after the balloon is inflated with air so that it conforms to the casing, is then tied to retain the air, the tied stem being concealed within the casing by the closure. The maximum safe diameter of the inflated balloon which is well below the diameter at which the balloon is close to its bursting point, is approximately equal to the maximum dimension of the expanded casing whereby the encased balloon has exceptional strength and the play ball may be subjected to rough handling.

7 Claims, 1 Drawing Sheet

Fig. 1.
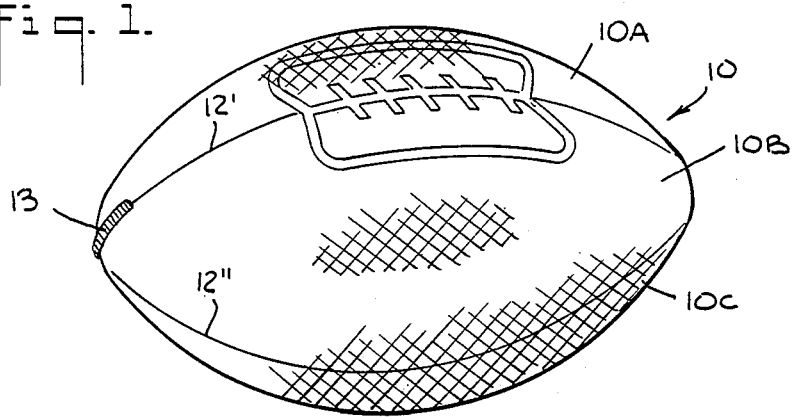
Fig. 2.
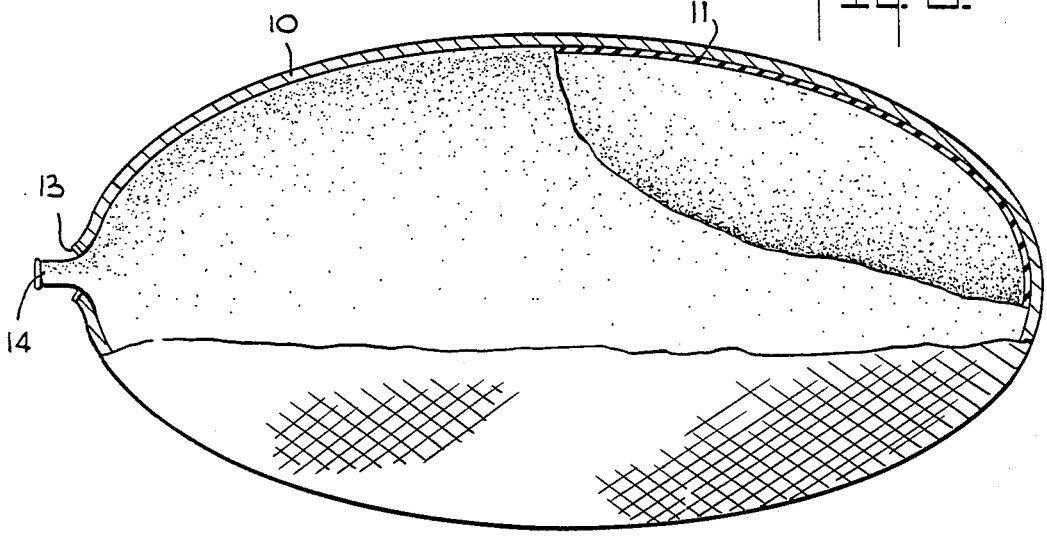
Fig. 4.
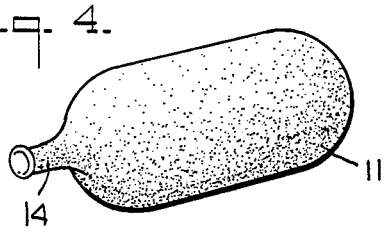
Fig. 3.
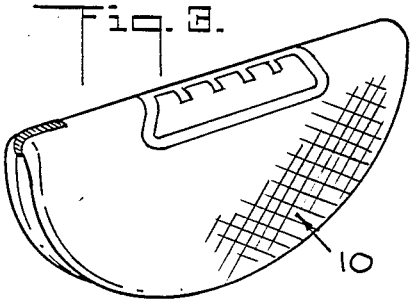
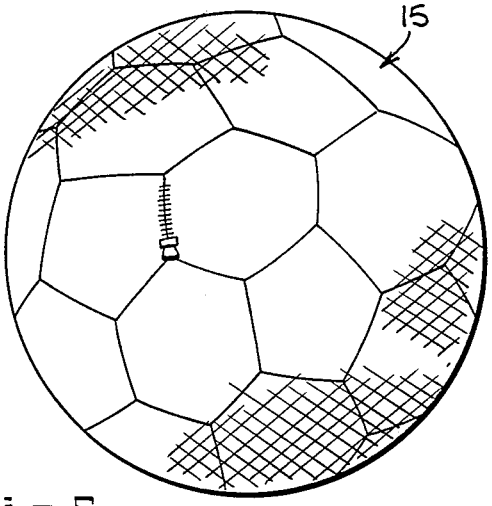
Fig. 5.

INFLATABLE PLAY BALL

BACKGROUND OF THE INVENTION

1. Field of Invention

This invention relates generally to play balls for young children who are incapable of handling conventional athletic balls, and more particularly to a lightweight, inflatable play ball whose inner bladder is a conventional rubber balloon, yet the ball is of exceptional strength so that it may be subjected in play to rough handling.

2. Status of Prior Art

A standard football is of oval shape and is made of an inflatable, high strength inner bladder and an outer casing formed of heavy leather, rubber or flexible plastic material. The bladder is provided wit a valve so that it can be inflated with air, the valve automatically closing to retain the air in the bladder. Made in a similar fashion are spherical soccer balls, volley balls and basketballs.

In play, standard sports play balls of the pneumatic type are tossed, kicked and bounced, the balls being capable of withstanding very rough handling. While such balls are not regarded by adults as unduly heavy, they represent an intolerable load to a young child. Moreover, a standard inflatable athletic ball tends to produce a "hand sting." This effect arises when the ball which has a hard casing is caught by the bare hands while moving at high velocity.

To overcome this drawback, the Barton et al. U.S. Pat. No. 3,256,019 incorporates cushioning in the outer casing of the inflated ball. But this cushioning does not reduce the weight of the ball.

While small children are attracted to conventional athletic balls and enjoy watching adults play soccer, football and other ball games, in the hands of a small child these athletic balls are heavy and dangerous, especially in indoor play. The standard inflated athletic ball has a relatively large diameter and a smooth, hard outer casing which makes it very difficult for a small child to grasp, throw and catch.

The toy and game industry has long recognized the need for a lighter, softer and potentially less dangerous ball for young children. Thus, balls in various shapes and sizes are now commercially available which are molded of polyurethane foam material and other lightweight compressible plastics. While such balls are safe in the hands of pre-school children and will inflict no harm even if the ball is hurled toward the body of another child, they fail in many respects to satisfy the typical child's desire for a ball that looks like a real athletic ball of the type used by adults, and is not an unconvincing substitute therefor.

To give a simple analogy, children enjoy playing with toy guns whose form and general appearance simulate those used in actual combat. But if a child were given a stick and told to pretend that this was a gun, he would not enjoy playing cops and robbers. By the same token, a small child who would like to play with a football wishes to have a ball that at least looks like a football and behaves like a football.

The soft play balls described in the Wexler U.S. Pat. No. 4,738,450 are provided with an outer casing and an inner core of shredded fibrous material. But such balls, while they look like a standard athletic ball, lack pneumatic characteristics and do not bounce.

Another practical drawback of a conventional inflatable play ball such as a football is that it cannot be collapsed, flattened out and folded to form a compact package. If, therefore, one wishes to take a conventional play ball to a park or beach for use by children, one must carry the ball in its inflated condition. This presents a problem if the parents accompanying the children are already loaded with folding chairs, picnic baskets and other articles appropriate to the occasion.

SUMMARY OF INVENTION

In view of the foregoing, the primary object of this invention is to provide play balls for young children whose configuration and external appearance are similar to those of conventional pneumatic athletic balls such as footballs and soccer balls, but whose physical characteristics are such as to render the play ball safe and usable by a young child.

More particularly, an object of this invention is to provide a play ball of the above type whose outer casing is formed of light-weight fabric material and whose inner bladder is a conventional rubber balloon, yet the ball has exceptional strength and can withstand rough handling. A ball in accordance with the invention is easy to grasp by a child, it does not sting and possesses good bounce.

A significant advantage of the invention is that when not in use, the ball can be collapsed into a highly compact form simply by deflating and removing the rubber balloon from the fabric casing and then folding the casing in the manner of a handkerchief.

Also an object of the invention is to provide play balls of the above type which can be manufactured and sold at very low cost compared to conventional play balls for children.

Briefly stated, these objects are attained in a child's play ball constituted by an outer casing and an inner inflatable bladder. The outer casing is formed by contoured segments of high strength, non-stretchable fabric material stitched together to define, when the casing is fully expanded, a play ball of the desired shape and size, such as a football or soccer ball. The inner bladder is a conventional rubber balloon whose stem initially projects through an opening in the casing which is provided with a closure. The stem, after the balloon is inflated with air so that it conforms to the casing, is then tied to retain the air, the tied stem being concealed within the casing by the closure. The maximum safe diameter of the inflated balloon which is well below the diameter at which the balloon is close to its bursting point, is approximately equal to the maximum dimension of the expanded casing whereby the encased balloon has exceptional strength and the play ball may be subjected to rough handling.

BRIEF DESCRIPTION OF DRAWINGS

For a better understanding of the invention as well as other objects and further features thereof, reference is made to the following detailed description to be read in conjunction with the accompanying drawings, wherein:

FIG. 1 illustrates, in perspective, an inflatable football in accordance with the invention;

FIG. 2 shows, in section, the football after it has been inflated and before the stem of the balloon has been tied;

FIG. 3 shows the fabric casing of the football after it has been folded for storage;

FIG. 4 illustrates the bladder of the ball; and

FIG. 5 illustrates a soccer ball in accordance with the invention.

DESCRIPTION OF INVENTION

Referring now to FIGS. 1 and 2, there is illustrated a football in accordance with the invention which has the configuration and external appearance of a standard football of oval shape.

The football is formed by an outer casing 10 and an inner bladder 11. Casing 10 is created by contour-cut, interfitting pieces 10A, 10B, 10C, etc., of non-stretchable fabric material sewn together by filamentary thread lines 12', 12" etc. Alternatively, if the fabric is formed of thermoplastic synthetic fibers, the pieces may be ultrasonically joined together. A preferred fabric for this purpose is parachute cloth which is a high-strength, light-weight, closely-woven fabric made of synthetic fibers such as nylon. Other types of non-stretchable fabrics such as Gore-Tex may be used for the casing material. At one end of casing 10 along a thread line is a small inlet opening provided with a slide fastener or zipper closure 13, the opening being large enough to permit insertion of a deflated bladder.

Bladder 11 disposed within casing 10 is constituted by a conventional rubber balloon having a stem 14 which initially projects through the opening in the casing so that the balloon can be mouth-inflated with air.

An inflated rubber balloon is easily punctured and notoriously weak in other respects. Indeed, one of the pleasures of playing with balloons is to burst and explode them. As a balloon is being inflated, its rubber skin stretches and the skin which is thin to begin with, becomes even thinner until a point is reached in the expanding diameter of the balloon where the skin is ruptured by the internal air pressure, at which point the balloon bursts.

Thus, a typical rubber balloon of a given initial size is characterized, when inflated, by a maximum safe diameter. As this term is used herein, the maximum safe diameter is the highest value reached in the course of inflating the balloon at which the rubber skin is still capable of sustaining the internal air pressure, beyond which diameter the balloon is unstable and approaches its bursting point. This maximum safe diameter for a balloon of a given initial size depends on the quality of the rubber skin and its thickness and density in the unstressed state.

In the present invention, the nature of the balloon must be such that its maximum safe diameter is about equal to the maximum dimensions of the casing. In the case of a football of oval form, its maximum dimension is the distance between the ends thereof. Hence, if this dimension is one foot, then the balloon must have a maximum safe diameter of about one foot. In the case of a spherical play ball such as a basketball, its maximum dimension is, of course, the diameter of the spherical ball.

Because the expanding balloon in the course of its inflation engages and presses against the inner surface of a non-stretchable casing, it is caused to conform to the contours thereof. Thus, while a balloon, if unconfined, would normally blow up to assume a generally spherical form, within the confines of an oval casing, it will assume an oval form.

After the balloon is so inflated within the non-stretchable casing, hollow stem 14 is tied or otherwise closed to retain the air in the balloon, and it is then pushed into the casing and the opening shut by closure 13. In practice, instead of a zipper for this purpose a Velcro fabric closure may be used.

In the case of an unconfined balloon, should one squeeze the balloon or subject it to pressure, then as the balloon is depressed in the region to which the pressure is applied, the resultant compression of the internal air will force the balloon skin to stretch in the unpressed regions thereof, and if the pressure is heavy, the balloon may burst. Thus, if ah unconfined balloon is inflated to its maximum safe diameter, say, a one-foot diameter, and the balloon is squeezed to cause it to assume a figure-of-eight pattern, the resultant stretching of the rubber skin which takes place in the unpressured regions of the balloon will exceed the safe limit and cause the balloon to burst.

But in the present invention, the balloon bladder is confined by the non-stretchable fabric casing; and regardless of how the balloon is handled, the balloon is not permitted to expand within the confines of the casing beyond its maximum safe diameter. We have found that an encased balloon so encased has exceptional strength, far greater than that of an unconfined balloon or a balloon confined within a stretchable casing. Indeed, tests have shown that the ball, when subjected to hundreds of pounds of pressure, will not burst. Thus, if a heavy adult sits on the ball, it will sustain this load.

The separate components of the football—that is, fabric casing 10 and balloon 11, as shown separately in FIGS. 3 and 4—can be stored in a compact state and put into a small storage or carrier envelope. FIG. 3 shows the oval casing folded flat into four segments, while FIG. 4 shows the uninflated balloon so that together they occupy little space.

The embodiment of the play ball 15 shown in FIG. 5 has the shape and external appearance of a soccer ball. In this instance, the outer casing is formed by pentagon-shaped, non-stretchable fabric pieces which are sewn or otherwise joined together. Some of these pieces are dyed black, while others are white, as in a standard athletic soccer ball. However, the diameter of the ball need not be as great as a standard soccer ball so that it can be handled more easily by a small child. The inner bladder is a rubber balloon, as in the case of the football.

Because the thin fabric casing is flexible and the balloon bladder is filled with compressible air, the fingers of a small child grasping the ball will press into and temporarily indent the ball to give the child a good grip on the ball. This gripping action is enhanced by the surface of the fabric which is somewhat rough as compared to smooth plastic. This physical characteristic of a ball in accordance with the invention makes it easy for a pre-school player to grasp, throw, bounce and catch the ball.

The balls illustrated in the drawing are by way of example only, and in practice a ball having a non-stretchable fabric casing and an inflatable balloon bladder in accordance with the invention may be made in any desired shape or given any desired appearance to resemble an actual athletic play ball of a particular type.

It is also to be noted that while one could use a balloon made of strong rubber as a play ball, one would, because of its lack of weight, have difficulty in throwing it, particularly under windy conditions where the wind would deflect the ball.

But the fabric-encased balloon, while not nearly as heavy as a leather or a plastic-encased pneumatic ball, has sufficient weight to permit easy throwing without, however, inflicting injury should the ball hit a child.

And to give greater weight to the balloon, its fabric may be made wet. This is particularly useful when playing on a windy beach.

When the ball is spherical in form, its fabric casing may be provided with a circular colored band at the equator to create, when the ball is thrown, a saturn-ring or flying saucer effect, particularly if the remainder of the casing is white.

Another significant advantage of a ball in accordance with the invention in which the bladder is an ordinary rubber balloon and the casing is non-stretchable as compared to a conventional beach ball which uses a non-stretchable inflatable plastic sphere, is that the former has a much higher internal air pressure than the latter and therefore considerably more bounce. The reason for this difference is that when blowing up a non-stretchable plastic ball, it takes little air pressure to do so, for the ball offers virtually no resistance to expansion until it is fully dilated. But with a rubber balloon, it takes much more air pressure to stretch the rubber from the original small form of the balloon to its fully stretched state.

While there have been shown and described preferred embodiments of an inflatable play ball in accordance with the invention, it will be appreciated that many changes and modifications may be made therein without, however, departing from the essential spirit thereof.

I claim:

1. A pneumatic play ball comprising:

(A) an outer case formed of non-stretchable, flexible fabric material which when the casing is fully expanded assumes a desired play ball configuration, said casing having a small opening therein to permit insertion into the casing of an inflatable bladder in its uninflated state, said casing opening being provided with a closure; and (B) a mouth-inflatable bladder in the form of a balloon formed of a thin rubber skin having an air-passage stem which initially projects through said opening and is then outside the casing to permit mouth inflation of the balloon within the casing to an extent causing it to engage and conform to the inner surface of the casing and to provide internal air pressure imparting high bounce characteristics to the ball, after which the stem is tied and pushed within the casing and the opening is then sealed by the closure whereby the inflated balloon is fully encased by the outer casing and no portion thereof can be extruded therefrom when the ball bounces.

2. A play ball as set forth in claim 1, wherein said casing has the shape of a standard athletic play ball and is formed of contoured pieces of said fabric material which are joined together.

3. A play object as set forth in claim 2, wherein said ball is a football.

4. A play object as set forth in claim 2, wherein said ball is a soccer ball.

5. A play object as set forth in claim 2, wherein said closure is a zipper.

6. A play ball as set forth in claim 2, wherein said balloon has a maximum safe diameter that is well below the diameter at which the balloon is close to its bursting point and is approximately equal to the maximum dimension of the expanded casing, whereby the encased balloon has exceptional strength and the play ball may be subjected to rough handling.

7. A play ball as set forth in claim 1, wherein said fabric is closely-woven parachute cloth formed of synthetic plastic fibers.

* * * * *